US005852874A

United States Patent [19]

Walker

[11] Patent Number: 5,852,874

[45] Date of Patent: Dec. 29, 1998

[54] CARTON CUTTING DEVICE HAVING A PIVOTAL GUARD MEMBER

[76] Inventor: Henry F. Walker, 7500 Manfrod Ct., Charlotte, N.C. 28217

[21] Appl. No.: 802,863

[22] Filed: Feb. 19, 1997

[51] Int. Cl.[6] ..... B26B 3/08; B26B 29/02; B67B 7/00

[52] U.S. Cl. ..... 30/2; 30/286; 30/294

[58] Field of Search ..... 30/2, 286, 289, 30/294, 295, 317, 335

[56] References Cited

U.S. PATENT DOCUMENTS

| | | | |
|---|---|---|---|
| D. 305,499 | 1/1990 | Walker . | |
| 2,254,199 | 9/1941 | Baltuch | 30/289 |
| 2,730,800 | 1/1956 | Bailey | 30/286 X |
| 3,009,248 | 11/1961 | Tilly | 30/294 |
| 3,092,903 | 6/1963 | Bockhold . | |
| 3,230,620 | 1/1966 | Embleton | 30/286 |
| 3,751,806 | 8/1973 | Patrick . | |
| 3,781,988 | 1/1974 | Jones | 30/286 X |
| 4,134,206 | 1/1979 | Beerman . | |
| 4,167,810 | 9/1979 | Gilbert . | |
| 4,198,751 | 4/1980 | Egbert . | |
| 4,675,996 | 6/1987 | DuBuque | 30/2 |
| 5,054,198 | 10/1991 | Gmoch | 30/2 |
| 5,241,750 | 9/1993 | Chomiak | 30/286 X |
| 5,522,135 | 6/1996 | Votolato | 30/2 |
| 5,617,635 | 4/1997 | Berns | 30/2 X |
| 5,697,157 | 12/1997 | Votolato | 30/2 |

FOREIGN PATENT DOCUMENTS

| | | |
|---|---|---|
| 560 115 | 9/1973 | Switzerland . |

*Primary Examiner*—Eugenia A. Jones

*Attorney, Agent, or Firm*—Kennedy Covington Lobdell & Hickman, LLP

[57] ABSTRACT

A carton cuing device includes housing and a guard member extending about the exterior of and pivotally attached to the housing. The housing includes a handle portion, neck portion, and hook portion which together define a cutting area therebetween and a channel therein for receiving and supporting a blade partially disposed in the cutting area. A frictionally slidable stop member is displaceable within the channel of the handle portion for abutting engagement with a blade received in the channel for supporting the blade from sliding within the channel. A spring is disposed between the guard member and the housing and urges the guard member into a first position in abutment with the hook portion for closing the cutting area to cutting. The guard member is displaceable by a carton to be cut to a second position in abutment with the handle portion for opening of the cutting area to cutting, and to all positions between the first and second positions for at least partial opening of the cutting area to cutting. During cutting, the spring continually urges the guard member into contact with the carton being cut, and relative movement of the carton through the cutting area causes the carton to engage the guard member so that the guard member is kept out of the first position. When the cutting device is withdrawn from the carton, the guard member is automatically displaced to the first position by the spring to shield against accidental cutting.

5 Claims, 7 Drawing Sheets

CARTON CUTTING DEVICE HAVING A PIVOTAL GUARD MEMBER

BACKGROUND OF THE INVENTION

The present invention generally relates to a carton cutting device and, particularly, to a carton cutting device having a housing defining a cutting area and a guard member pivotable between a first position in which the cutting area is closed for cutting and a second position in which the cutting area is open for cutting.

Carton cutting devices are well known in the art. For example, Bockhold, U.S. Pat. No. 3,092,903, and Gilbert, U.S. Pat. No. 4,167,810, both disclose cutting devices for cutting cardboard cartons. In the cutting device of Bockhold, the blade is moved between a retracted position within the handle when not in use and an extended position for cutting when used. In the cutting device of Gilbert, the blade is removably fixed to a handle having a guide member for guiding the cutting of a carton without damaging the contents of the carton.

Accordingly, it is an objective of the present invention to provide a carton cutting device having a guard member that is pivotally attached to a housing defining a cutting area for movement between a first position covering a cutting blade within the cutting area for preventing accidental cutting and a second position at least partially retracted from the cutting area to at least partially expose for cutting a cutting blade within the cutting area.

SUMMARY OF THE INVENTION

The carton cutting device of the present invention includes: (i) a generally flat elongate housing that includes a handle portion, a neck portion extending from one end of the handle portion, and a hook portion extending from the other end of the neck portion opposite the handle portion, with the handle portion, the neck portion, and the hook portion together defining a cutting area therebetween; (ii) a guard member that extends about the exterior of and is pivotally attached to the housing for pivotable movement between a first position in abutting engagement with the hook portion covering a cutting blade disposed in the cutting area wherein the cutting area is closed for cutting for preventing accidental cutting, and a second position pivoted toward the handle portion at least partially retracted from the cutting area to at least partially expose for cutting a cutting blade disposed in the cutting area wherein the cutting area is open for cutting; and (iii) a spring that is disposed between the handle portion and the guard member for urging the guard member toward the first position.

In a feature of the present invention, the housing includes a channel extending from one end of the handle portion through the handle portion to the cutting area and is configured to receive and support a blade partially disposed in the channel and partially disposed in the cutting area. Moreover, the carton cutting device further includes a stop member that is configured and sized to be frictionally slidable within the channel for abutting and retaining a blade supported in the channel extending across the cutting area.

In yet a further feature of the present invention, the guard member includes a projecting free end distal from the location of the pivotal attachment of the guard member to the housing, the free end having a surface facing outwardly from the housing for engagement with the carton to be cut and profiled to induce displacement of the guard member out of the first position upon engagement of the surface with the carton Preferably the hook portion includes a pointed end for insertion into the carton for guiding of the carton cutting device during cutting of the carton, and the pointed end preferably projects generally parallel to the free end of the guard member when the guard member is in the first position.

In another feature of the present invention, the guard member is initially pivoted towards the handle portion and away from the hook portion for introduction of a carton into the cutting area for cutting, and the spring continually urges the guard member toward the first position during cutting. However, the cutting movement of the carton in engagement with the surface of the free end of the guard member urges and maintains the guard member out of the first position in opposition to the spring.

In a preferred embodiment of the present invention, the guard member is pivotable to a second position in abutting engagement with the handle portion whereat the cutting area is open for cutting, and to all positions between the first and second positions in which the cutting area is at least partially exposed for cutting.

DETAILED DESCRIPTION OF THE PREFERRED EMBODIMENT

Figure 1:
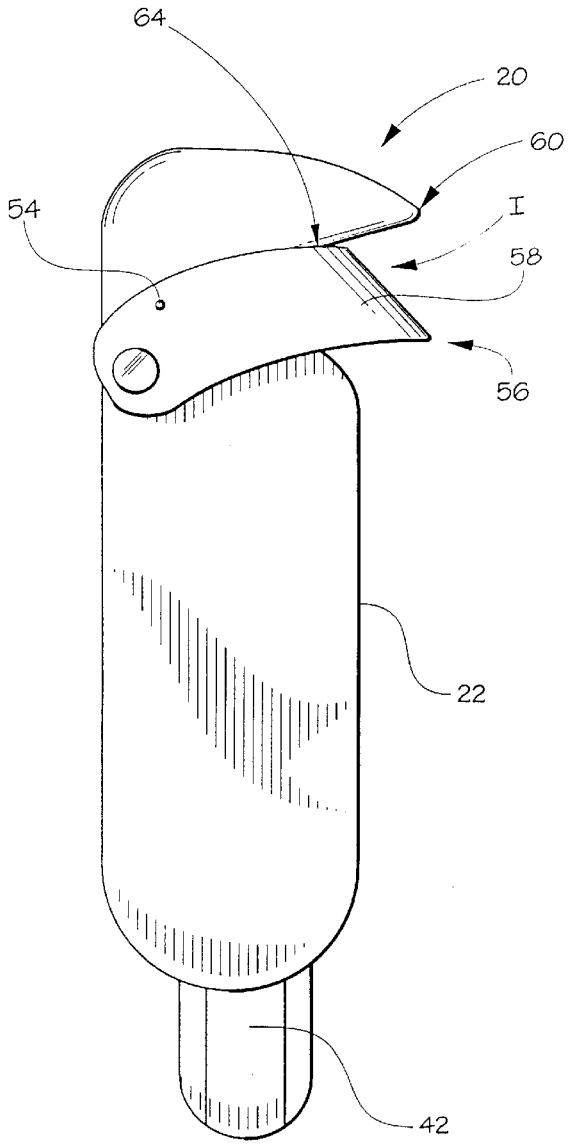
FIG. 1 is a side view of the carton cutting device of the present invention.

Referring to FIGS. 1–11, the preferred carton cutting device 20 of the present invention includes a generally flat elongate housing 22 which defines a cutting area 24. Specifically, the housing 22 includes a handle portion 26, a neck portion 28 that extends from one end of the handle portion 26, and a hook portion 30 that extends from one end of the neck portion 28 opposite the handle portion 26. Moreover, the handle portion 26, the hook portion 30, and the neck portion 28 define the cutting area 24 therebetween.

A channel 32 is defined by the housing 22 and extends through the handle portion 26, neck portion 28 and hook portion 30 for receiving and supporting a blade 34 in the cutting area 24. In particular, the channel 32 extends from an end 36 of the handle portion 26 opposite the neck portion 28 to the cutting area 24. The channel 32 also partially extends along the neck portion 38 and partially into the hook portion 30. A blade 34 is insertable into the end 36 of the handle portion 26 and slidable through the handle portion 26 to the cutting area 24. When the blade 34 is fully inserted into the handle portion 26, the back of the blade 34 is supported within the channel 32 in the neck portion 28, the first end 38 of the blade 34 is supported within the channel 32 in the hook portion 30, and the other end 40 of the blade 34 is supported in the channel 32 in the handle portion 26. A stop member 42 is configured to be frictionally slidable within the channel 32 in the handle portion 26 for supporting and maintaining in abutting engagement the blade 34 when partially disposed in the cutting area 24. Furthermore, an end 44 of the stop member 42 is configured to completely engage the end 40 of the blade 34 for full support and retention of the blade 34 within the cutting area 24.

A guard member 46 is pivotally attached to the housing 22 by pivot pins 48 and, in particular, to the handle portion 26, and a spring 50 is disposed between the handle portion 26 and guard member 46 urging pivotable movement of the guard member 46 toward the first position I. The spring 50 preferably is a conventional torsion spring having one end attached to the housing 22 (not shown) and the other end disposed within an opening 54 in the guard member 46. The guard member 46 is pivotable between a first position I and a second position II and all positions therebetween, but is urged by the spring 50 towards the first position I.

At the first position I, the guard member 46 is disposed in engaging abutment with the hook portion 30, covers the blade 34 disposed in the cutting area 24, and closes the cutting area 24 to cutting. Therefore, when the carton cutting device 20 is not being used, the spring 50 keeps the guard member 46 in the first position I and the cutting area 24 closed for cutting, thereby preventing accidental cutting.

At the second position II defining the other end of the arcuate path through which the guard member 46 is pivotable, the guard member 46 is disposed in engaging abutment with the handle portion 26, does not cover the blade 34 disposed in the cutting area 24, and opens the cutting area 24 to cutting. In addition, in the positions between the first position I and the second position II, the guard member 46 is at least partially retracted from the cutting area 24 thereby at least partially exposing the blade 34 for cutting.

Figure 2:
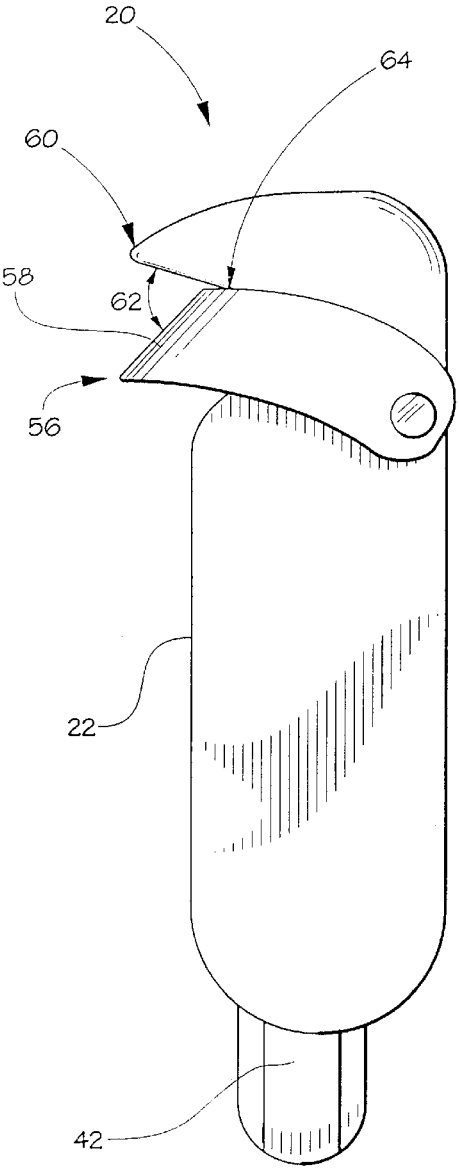
FIG. 2 is a side view of the opposite side of the cutting device of FIG. 1.
Figure 3:
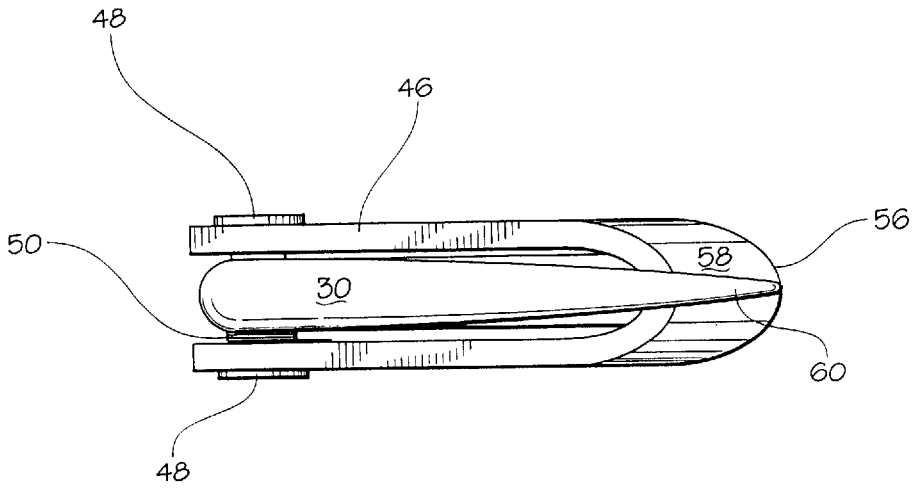
FIG. 3 is a top view of the carton cutting device of FIG. 1.
Figure 4:
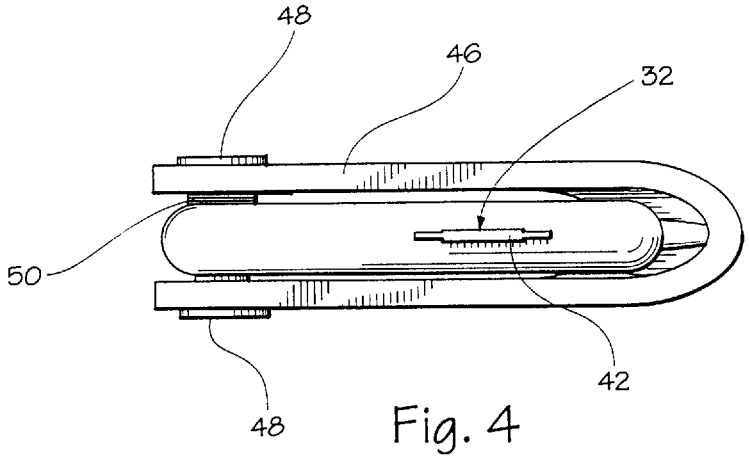
FIG. 4 is a bottom view of the carton cutting device of FIG. 1.
Figure 5:
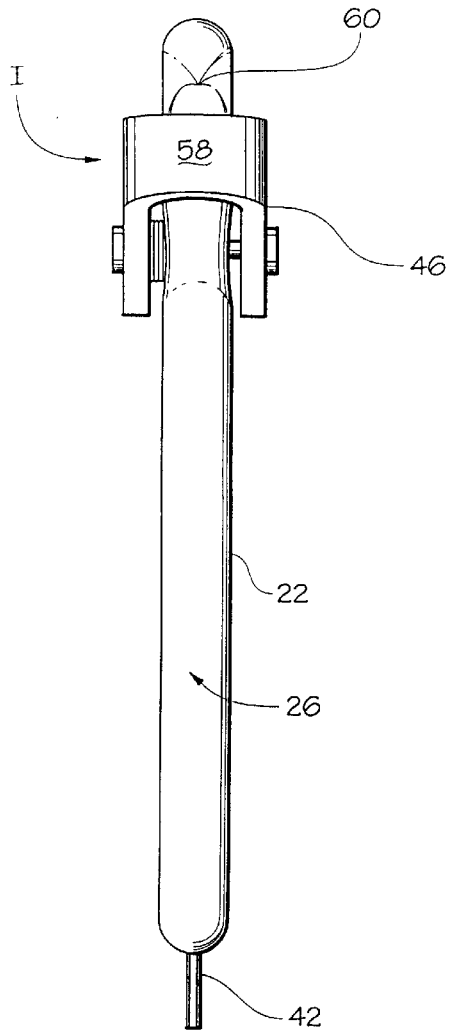
FIG. 5 is a front view of the carton cutting device of FIG. 1.
Figure 6:
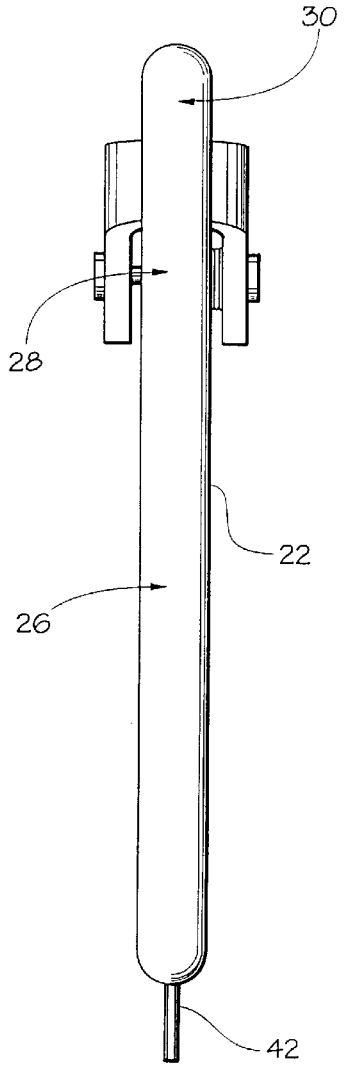
FIG. 6 is a back view of the carton cutting device of FIG. 1.
Figure 7:
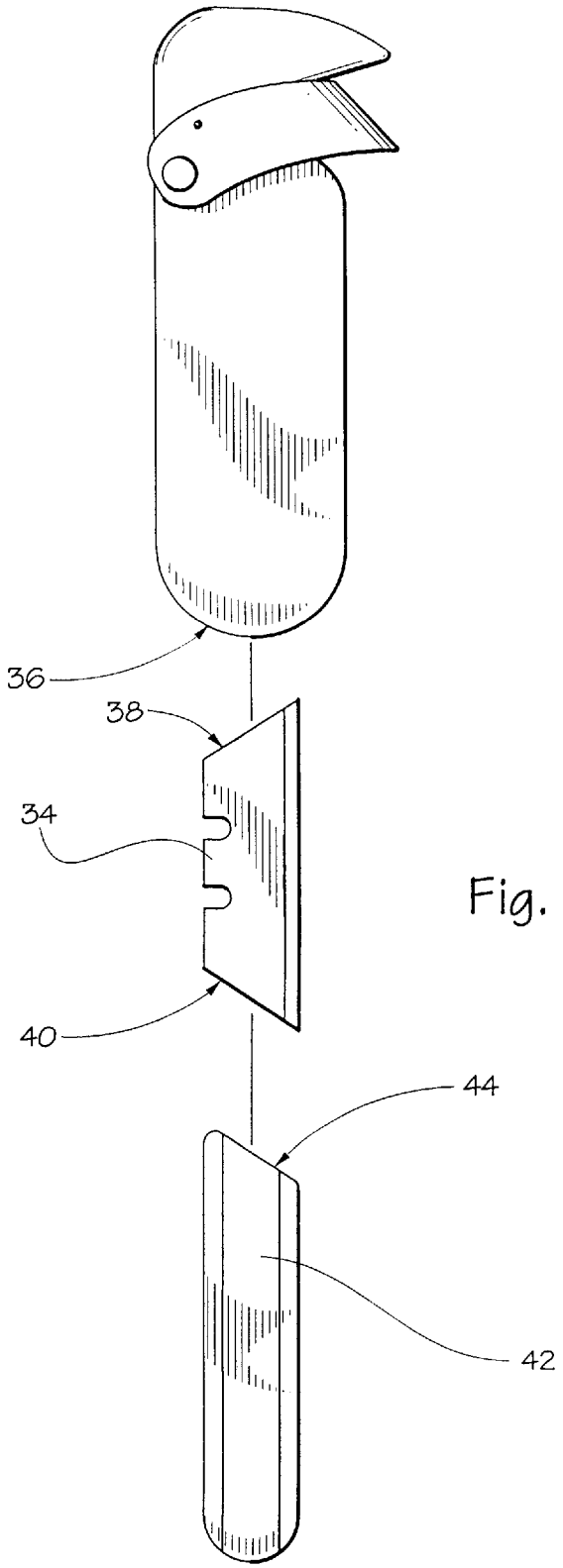
FIG. 7 is an exploded view of the carton cutting device of FIG. 1.
Figure 8:
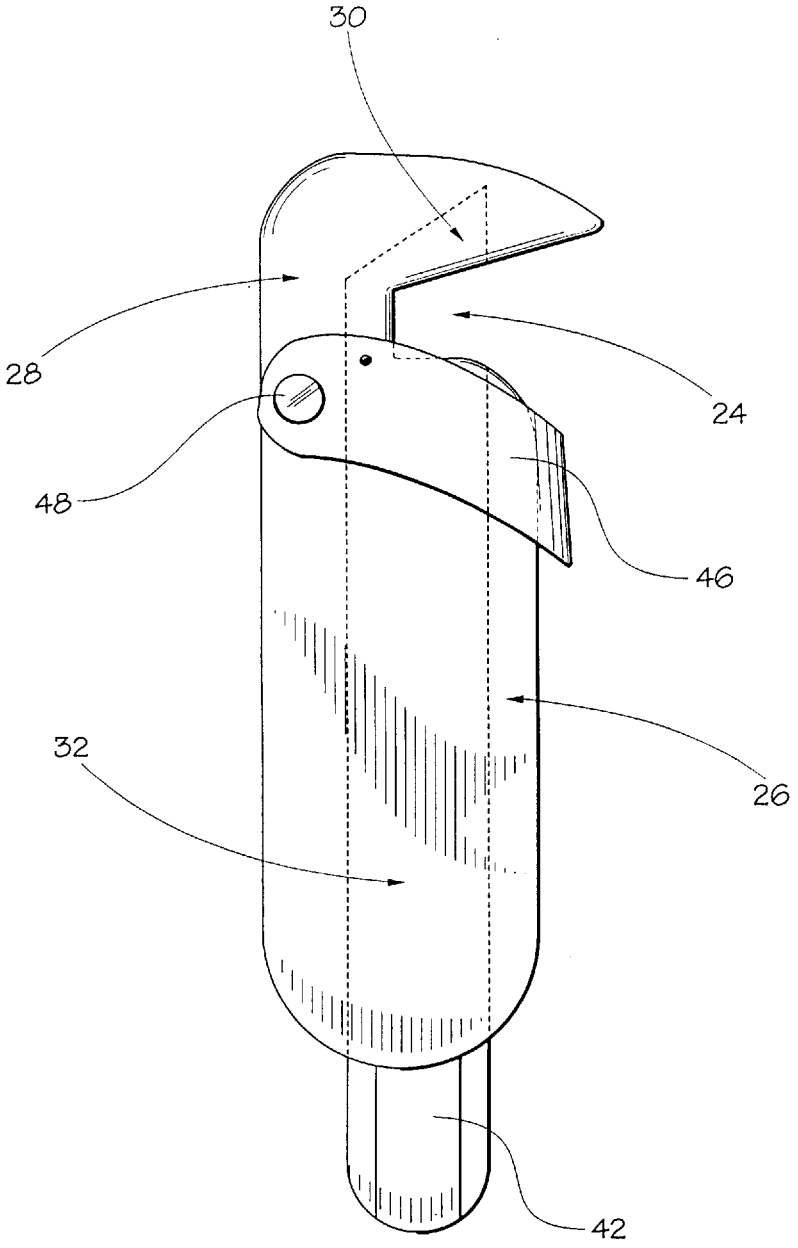
FIG. 8 is a side view of the carton cutting device of the present invention without a blade and with the guard member pivotally displaced from the first, closed position.
Figure 9:
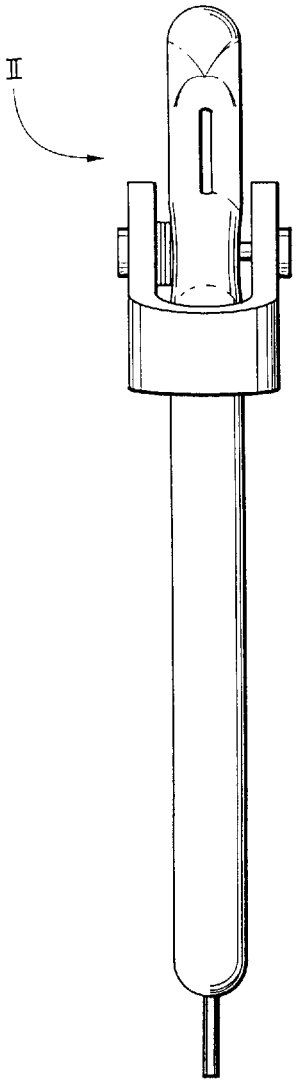
FIG. 9 is a front view of the carton cutting device of FIG. 8.
Figure 10:
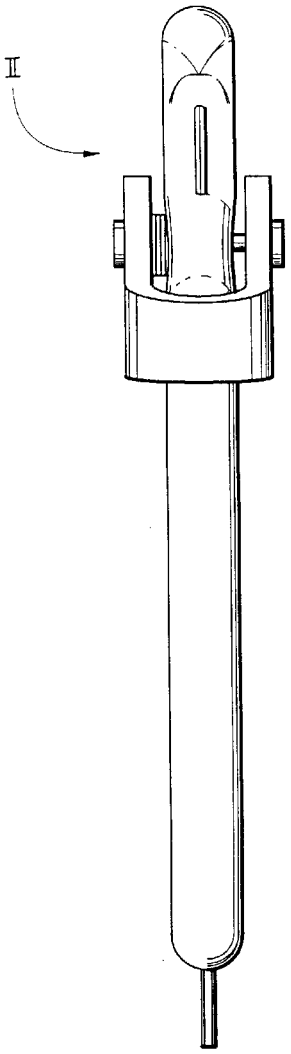
FIG. 10 is a front view of the carton cutting device of FIG. 1 with the guard member pivotally displaced from the first, closed position.
Figure 11:
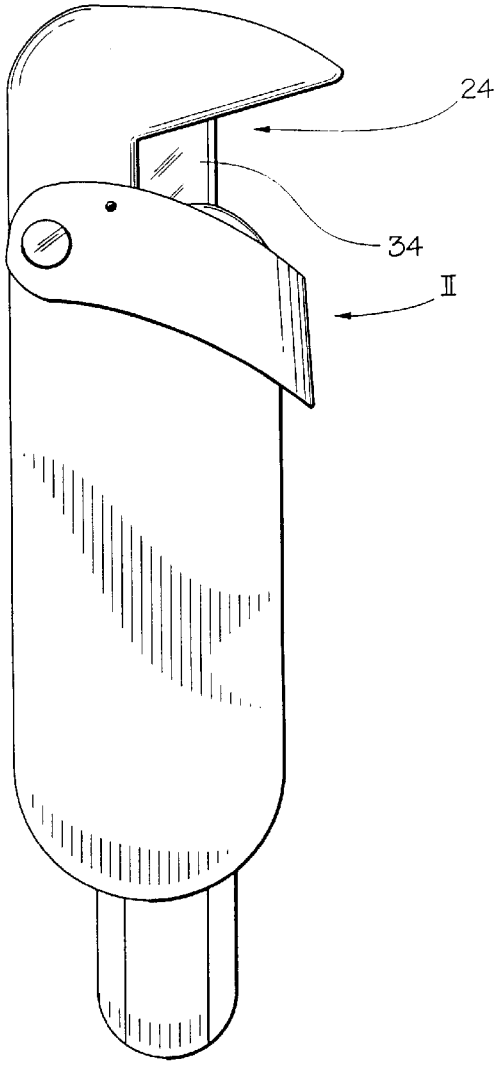
FIG. 11 is a side view of the carton cutting device of FIG. 10.

The guard member 46 includes a projecting free end 56 distal from the location of the pivotal attachment of the guard member 46 to the housing 22 by the pivot pins 48. Moreover, the free end 56 includes a surface 58 that faces outwardly from the housing 22 for engagement with a carton to be cut. The free end 56 is profiled to induce displacement of the guard member 46 out of the first position I upon engagement with the carton. In addition, the hook portion 30 preferably includes a pointed end 60 for inserting into a carton to be cut for guiding of the cutting device, as described below. The pointed end 60 moreover generally projects from the housing 22 in a direction parallel to the free end 56 of the guard member 46 when the guard member 46 is disposed in the first position I. Therefore, when the pointed end 60 is inserted into a carton, the free end 56 of the guard member 46 will likely engage the carton as well for pivoting of the guard member 46 out of the first position I for cutting, as described below. Furthermore, as shown in FIG. 2, the hook portion 30 and the guard member 46 are configured so that an acute angle 62 is formed therebetween for ease of insertion of a carton to be cut. Moreover, the acute angle 62 provides for the automatic displacement of a carton forced between the hook portion 30 and guard member 46 towards the abutting engagement 64 therebetween when the carton cutting device 20 is used as described below.

The method and use of the preferred embodiment of the carton cutting device 20 of the present invention will now be described. The carton cutting device 20 is designed for quickly and easily opening cardboard cartons and boxes. The carton cutting device 20 is first gripped about the handle portion 26 with the hook portion 30 and free end 56 projecting in a direction away from the palm towards the fingers. The hook portion 30 is inserted at a corner of the carton. During this insertion, the free end 56 and surface 58 of the guard member 46 come into contact with the carton. Slight pivotable movement of the housing 22 while pushing the free end 56 or surface 58 of the guard member 46 against the carton will cause the housing 22 to pivot about the guard member 46 such that the cutting area 24 is exposed for cutting. In addition, because of the acute angle 62 formed between the surface 58 of the free end 56 of the guard member 46 and hook portion 30, the forcing of the carton between the guard member 46 and hook portion 30 towards the abutment 64 of the guard member 46 and the hook portion 30 will causes the guard member 46 to pivot away from the hook portion 30 towards the handle portion 26 thereby exposing the cutting area 24 and the blade 34 to cutting. Once the guard member 46 has been pivoted out of the first position I, the carton to be cut can be quickly moved through the cutting area 24 by quick displacement of the cutting device 20. Moreover, the carton is angled through the cutting area 24 such that the surface 58 of the guard member 46 engages and rides upon the carton being cut, which in turn causes the continual displacement of the guard member 46 out of the first position I. Moreover, during the carton cutting process, the carton engages the guard member 46 first and then enters the cutting area 24. When the carton cutting device 20 has finished cutting through the carton and emerges therefrom, the guard member 46, which has been continuously urged by the spring 50 toward the first position I, immediately returns to the first position I for guarding against accidental cutting.

It will therefore be readily understood by those persons skilled in the art that the present invention is susceptible of a broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A carton cutting device comprising:

a housing including an elongate handle portion having two ends and extending therebetween in a generally lengthwise direction, a neck portion attached to one of said ends of said handle portion, and a hook portion attached to said neck portion, said handle portion, said neck portion, and said hook portion together defining a recessed cutting space, said hook portion including a pointed end tapering generally to a point in a transverse direction generally perpendicular to said lengthwise direction of said handle portion;

a cutting blade retained within said housing and partially disposed within said cutting space for cutting;

a guard member pivotally attached to said housing for pivotable movement between a first position, wherein said guard member abuts said hook portion and covers said cutting blade to prevent accidental cutting, and a second position, wherein said guard member at least partially uncovers said cutting blade for cutting, said guard member including a surface extending across said recessed cutting space to cover said cutting blade disposed therein thereby preventing accidental cutting when said guard member is in said first position, said surface further being profiled to induce displacement of said guard member out of said first position upon engagement in the transverse direction of said surface with a carton to be cut; and a spring disposed between said housing and said guard member for urging said guard member towards said first position.

2. A carton cutting device according to claim 1, wherein said surface of said guard member forms an acute angle with said tapering hook portion.

3. A carton cutting device according to claim 1, wherein a cutting edge of said cutting blade extends in said cutting space generally parallel to said lengthwise direction of said handle portion.

4. A carton cutting device according to claim 1, wherein said pointed end of said hook portion is insertable into the carton for guiding the cutting of the carton in said transverse direction.

5. A carton cutting device according to claim 1, wherein said guard member is initially pivoted towards said handle portion and away from said hook portion for introduction of the carton into said cutting space for cutting, and wherein said spring continually urges said guard member into engagement with the carton during transverse cutting movement, said transverse cutting movement maintaining said guard member out of said first position.

* * * * *